US011705661B2

(12) United States Patent
Zhang

(10) Patent No.: US 11,705,661 B2
(45) Date of Patent: Jul. 18, 2023

(54) MODULAR COMBINED SOCKET AND MODULAR POWER SUPPLY ASSEMBLY

(71) Applicant: OmniMax USA, LLC, Anna, TX (US)

(72) Inventor: Dabing Zhang, Yangzhou (CN)

(73) Assignee: OmniMax USA, LLC, Anna, TX (US)

( * ) Notice: Subject to any disclaimer, the term of this patent is extended or adjusted under 35 U.S.C. 154(b) by 252 days.

(21) Appl. No.: 17/211,712

(22) Filed: Mar. 24, 2021

(65) Prior Publication Data

US 2021/0305746 A1 Sep. 30, 2021

(30) Foreign Application Priority Data

Mar. 25, 2020 (CN) ..... 202010220498.8

(51) Int. Cl.
*H01R 13/502* (2006.01)
*H01R 13/514* (2006.01)

(52) U.S. Cl.
CPC ..... *H01R 13/514* (2013.01)

(58) Field of Classification Search
CPC .. H01R 13/502; H01R 13/506; H01R 13/514; H01R 13/516; H01R 13/518
USPC ..... 439/535, 701
See application file for complete search history.

(56) References Cited

U.S. PATENT DOCUMENTS 5,219,296 A * 6/1993 Nguyen ..... H01R 13/6581 439/95
10,179,517 B2 * 1/2019 Toth ..... B60L 53/65
2021/0305746 A1 * 9/2021 Zhang ..... H01R 13/514

* cited by examiner

*Primary Examiner* — Khiem M Nguyen
(74) *Attorney, Agent, or Firm* — Frank M. Scutch, III

(57) ABSTRACT

A modular combined socket, which comprises a circuit module, a connection module and at least two socket modules. The circuit module includes a connection module interface and a socket interface with at least four conductive paths connected to each other. The connection module includes a power supply interface and a circuit module interface with at least four conductive paths that are connected to each other and can be connected to the connection module interface of the circuit module through the circuit module interface, and the socket module includes two or three interconnected socket modules. The output socket and line interface of the conductive path, each of the socket modules can be connected to different conductive paths of the socket interface through the line interface. It has the advantages of flexible combination, large load bearing and strong anti-interference. The present invention also provides a modular power supply assembly.

20 Claims, 10 Drawing Sheets

MODULAR COMBINED SOCKET AND MODULAR POWER SUPPLY ASSEMBLY

FIELD OF THE INVENTION

The present invention relates to a power socket and more particularly a modular combined socket and power supply assembly.

BACKGROUND

A power socket is a device used to introduce electrical power from a main power supply system to the wall or ceiling of a house or office building. Power is typically delivered in close proximity to an electrical appliance. With the increase in people and electrical products, the number of appliances has also increased requiring additional power sockets.

When there are multiple electrical appliances in the room, several power sockets are typically used at the same time. In large indoor spaces, there often are multiple workstations in different locations in the room. When each workstation has multiple electrical appliances, it is often necessary to use multiple power sockets to supply power to these electrical appliances. An existing power socket usually has three circuit channels, which provide live, neutral, and ground paths for electrical appliances. When multiple electrical appliances are used at the same time, each electrical appliance is connected to the same electrical line, which can cause mutual interference between devices. In addition, with the increase in the number of connected electrical appliances, and increase in power drain, the power socket bears a greater load, especially the socket directly is connected to the main power supply system in the wall or ceiling, which is likely to cause the power socket to be overloaded which raises safety issues In order to provide a tidy wire installation, electrical outlets are often wired through furniture or desks. In order to provide power to multiple electrical appliances, multiple power sockets are used. The connecting cables between multiple power outlets can easily lead to disorderly arrangement of cables, which affects the appearance and cleanliness of the house or office. Consequently, new solutions are needed for providing power in home and business environments.

SUMMARY OF THE INVENTION

The technical problem to be solved by the present invention is to provide a modular combined socket, which can provide multiple power sockets with different circuit channels and has a large power supply load.

An additional technical problem to be solved by the present invention is to provide a modular power supply assembly with many power supply connection points and a large power supply load. To solve the above-mentioned technical problems, one aspect of the present invention provides a modular combined socket. The modular combined socket includes a circuit module, a connection module and at least two socket modules. The circuit module includes at least four conductive paths connected to each other. The connection module interface and the socket interface of the connection module include a power interface and a line module interface with at least four conductive paths connected to each other, and the connection module can be connected to the connection module interface of the line module through the line module interface The socket module includes a power output socket and a line interface that are connected to each other, and different socket modules can be connected to different conductive paths of the socket interface through their respective line interfaces.

Preferably, the socket module has a square shape, and each power module includes two power output sockets, and the two power output sockets are arranged on a pair of opposite faces of the socket module. Through this preferred technical solution, one socket module can provide two power output sockets, which increases the number of power output sockets provided by the modular combined socket of the present invention.

Further preferably, there are two connection module interfaces, which are respectively arranged at both ends of the circuit module, there are two socket interfaces, and the two socket interfaces are arranged on the same plane of the circuit module; There are two socket modules, the two socket modules are arranged side by side, and are respectively connected to the two socket interfaces through the line interface, and there are two connection modules, which are respectively connected to both ends of the line module. In this preferred technical solution, two socket modules can provide four sets of power output sockets, and simultaneously meet the use needs of four electrical equipment. The power module is arranged to connect to the side of the circuit module, and the two connection modules are arranged at both ends of the power module and the circuit module, which not only can form a stable connection, but also can easily form a plurality of modular models of the present invention through the connection modules at both ends. The interconnection between modular sockets.

Further, the line module includes a first line module and a second line module, the connection module interface includes a first connection module interface and a second connection module interface, and the socket interface includes a first socket interface and a second socket interface, The first connection module interface and the first socket interface are located on the first circuit module, and the second connection module interface and the second socket interface are located on the second circuit module; the circuit The interface includes a first line interface and a second line interface. The first line interface and the second line interface are respectively arranged on another pair of opposite faces of the socket module; the socket module passes through the first line interface respectively The connection with the first socket interface and the connection between the second line interface and the second socket interface are arranged between the first line module and the second line module; the line module interface includes a first line A module interface and a second line module interface, the first line module interface is connected to the first connection module interface, and the second line module interface is connected to the second connection module interface. Through this preferred technical solution, the conductive paths connecting the power supply live wire and the ground and neutral wires can be arranged in different circuit modules to realize the mutual isolation of the power supply live wire and the ground and neutral conductive paths, and reduce the mutual interference of currents in different conductive paths, and improve the safety of the power conductive path. At the same time, the structure in which the socket module is arranged between the two circuit modules can also improve the stability of the socket module during use.

Specifically, the circuit module includes a circuit housing and at least four mutually insulated circuit conductors arranged in the circuit housing, each of the circuit conductors forms a conductive path; both ends of the circuit conductor are provided with One socket, two sockets are provided at corresponding positions on the side; sockets at both ends of the circuit module respectively form the connection module interfaces, and sockets at different positions on the side respectively form the socket interfaces; and/or, The connecting module includes a connecting shell, a connecting bracket, and at least four connecting conductors; each of the connecting conductors is insulated from each other and fixed on the connecting bracket, and is arranged in the connecting shell together with the connecting bracket. The connecting conductors respectively form a conductive path. One end of the connecting conductor forms a plug that passes through the connection housing, and the other end forms a plug located in the connecting bracket. The exposed plug at one end of the connecting module forms for the line module interface, the plug at the other end in the connecting bracket forms the power interface. In this specific technical solution, the conductive path and the connection interface are directly formed by a line conductor, which reduces the connection joints in the circuit conductive path, improves the current carrying capacity of the conductive path, and reduces the current loss in the transmission process. A connecting conductor in the connecting module forms a conductive path from the power interface to the line module interface. There is no intermediate joint in the conductive path, which improves the current carrying capacity of the conductive path in the connecting module and reduces the current loss during transmission.

Preferably, the modular combined socket of the present invention further includes an intermediate connector module, both ends of the intermediate connector module are provided with interconnecting intermediate interfaces, and the intermediate interfaces at both ends are both suitable for connecting with the connection module interface. Through this preferred technical solution, both ends of the intermediate connector module can be connected to the line module, and more line modules can be connected to more socket modules, so that the modular combined socket of the present invention can be equipped with more power sources. Output jack.

Preferably, the socket module includes a socket shell, a socket conductor and a socket panel, the socket conductor is arranged in the socket shell, the socket panel is arranged on the side of the socket shell, and the socket panel is provided with a standard The power output socket of the socket, one end of the socket conductor protrudes from different positions of the socket housing to form the line interface that can be connected to different connection channels of the socket interface, and the other end is connected to the power output socket. In this preferred technical solution, the power output socket can be connected to different conductive paths of the line module through the socket conductor, forming a connection with different live and neutral paths from the power supply system, or different live, neutral, and ground paths. The connected socket module.

The second aspect of the present invention provides a modular power supply assembly, which uses the modular combined socket provided by the first aspect of the present invention. Preferably, the modular power supply assembly of the present invention includes a power cable, a connecting cable and at least two modular combined sockets, one end of the power cable is connected with a power connector, and the other end can be connected with a power supply system; Both ends of the connecting cable are connected to one of the power connectors; the power connector can be connected to the power interface on the modular combined socket; the power cable is connected to one of the modular sockets. The combined sockets are connected, and the modular combined sockets are connected to each other through the connecting cable. In this preferred technical solution, a modular combined socket is connected to different wire lines of the power supply system through a power cable, which can provide multiple power output sockets connected to different wire lines. Multiple modular sockets can be connected to each other by connecting cables to form multiple modular sockets connected to different wires in the power supply system, providing more power output sockets connected to different wires and Provide longer power supply distance.

Through the above technical solutions, the modular combined socket of the present invention can provide power output sockets that are compatible with the number of electrical appliances by means of module connection. The modular combined socket of the present invention can reasonably share the power load of high-power electrical appliances through different conductive paths, and ensures the balance of the power supply load on each conductive path. Therefore, the total carrying current of the combined socket is larger. The modular combined socket of the present invention has many power outputs sockets, a larger power supply load, and less current interference between different power output sockets.

The modular power assembly of the present invention adopts the modular combined socket of the present invention, which can form more power supply connection points and provide a larger power supply load. With the modular power assembly composed of a plurality of modular combined sockets of the present invention, there are more combinations of socket modules and more connection modes between the combined sockets.

The other features and advantages of the present invention will be described in detail in the following specific embodiments.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
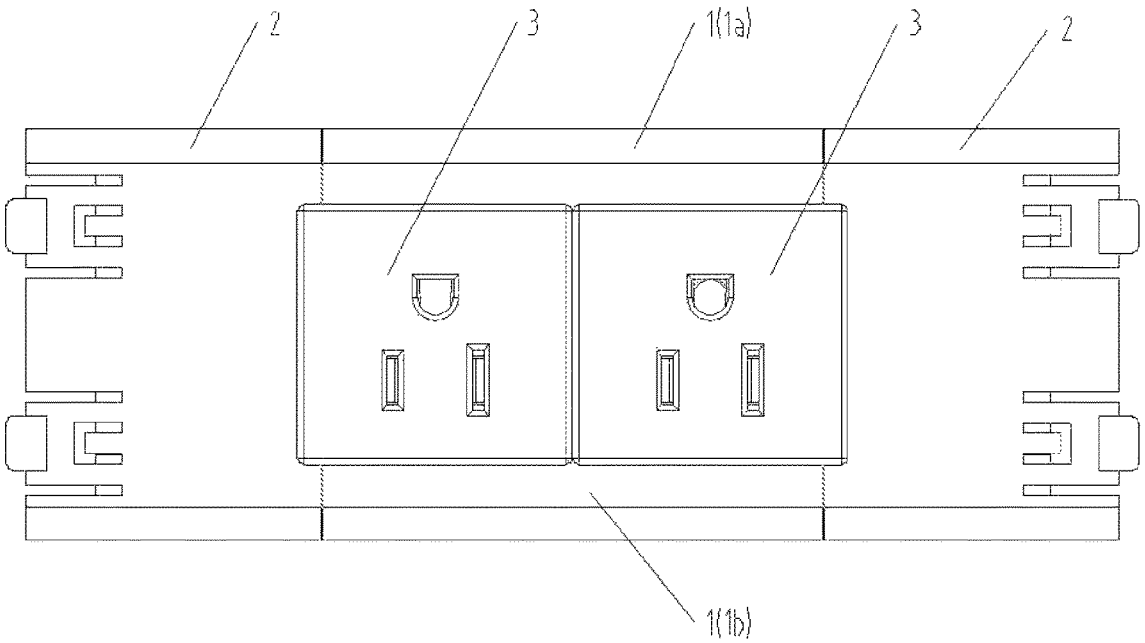
FIG. 1 is a schematic diagram of a modular combined socket of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to {replace with a technical description of the invention in a few words}. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

The specific embodiments of the present invention will be described in detail below in conjunction with the drawings. The specific embodiments described here are only used to illustrate and explain the present invention, and the scope of protection of the present invention is not limited to the following detailed ways.

In the present invention, unless otherwise stated, the orientation words used such as "up, down, left, right" usually refer to the orientation or positional relationship shown in the drawings, where the standard power output socket. The side where the ground wire is connected to the jack is the upper side. The description of each module is based on its orientation or position relationship after being assembled in the modular socket of the present invention.

In addition, the terms "first" and "second" are only used for descriptive purposes and cannot be understood as indicating or implying the relative importance or implicitly indicating the number of technical features indicated. Therefore, the terms "first", The "second" feature may explicitly or implicitly include one or more of the features.

In the description of the present invention, it should be noted that, unless otherwise clearly specified and limited, the terms "installation", "setting", and "connection" should be understood in a broad sense. For example, "connection" can be a fixed connection, or It may be a detachable connection or an integral connection; it may be a direct connection or an indirect connection through an intermediate medium, and it may be the internal communication between two components or the electrical connection relationship between the two components. For those of ordinary skill in the art, the specific meaning of the above-mentioned terms in the present invention can be understood according to specific circumstances.

Figure 2:
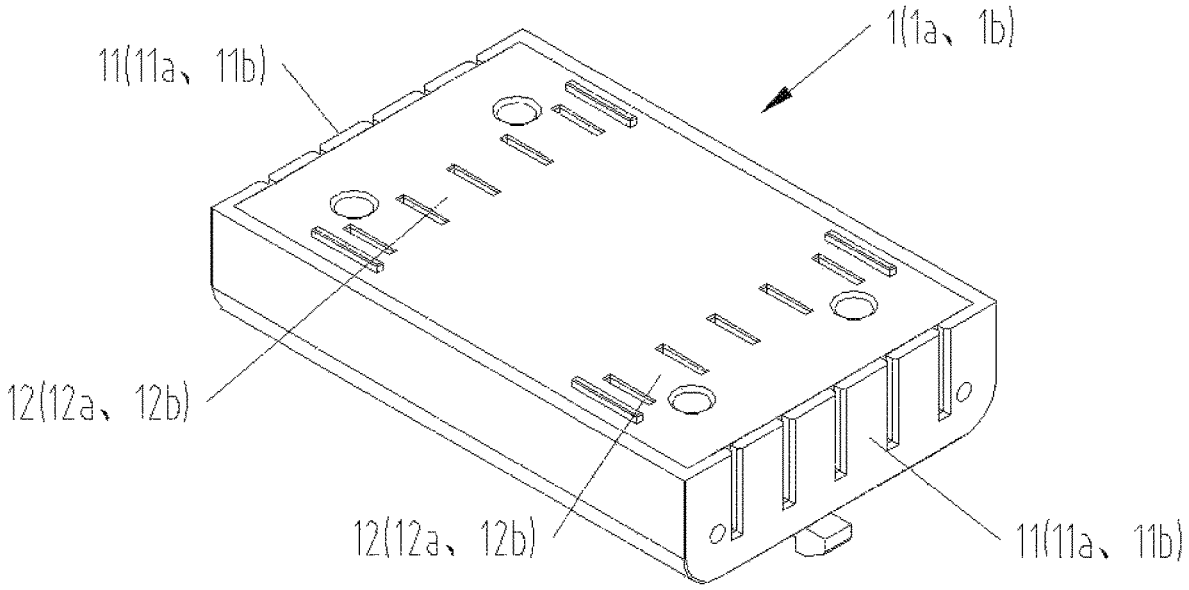
FIG. 2 is a schematic diagram of a circuit module of the present invention.
Figure 4:
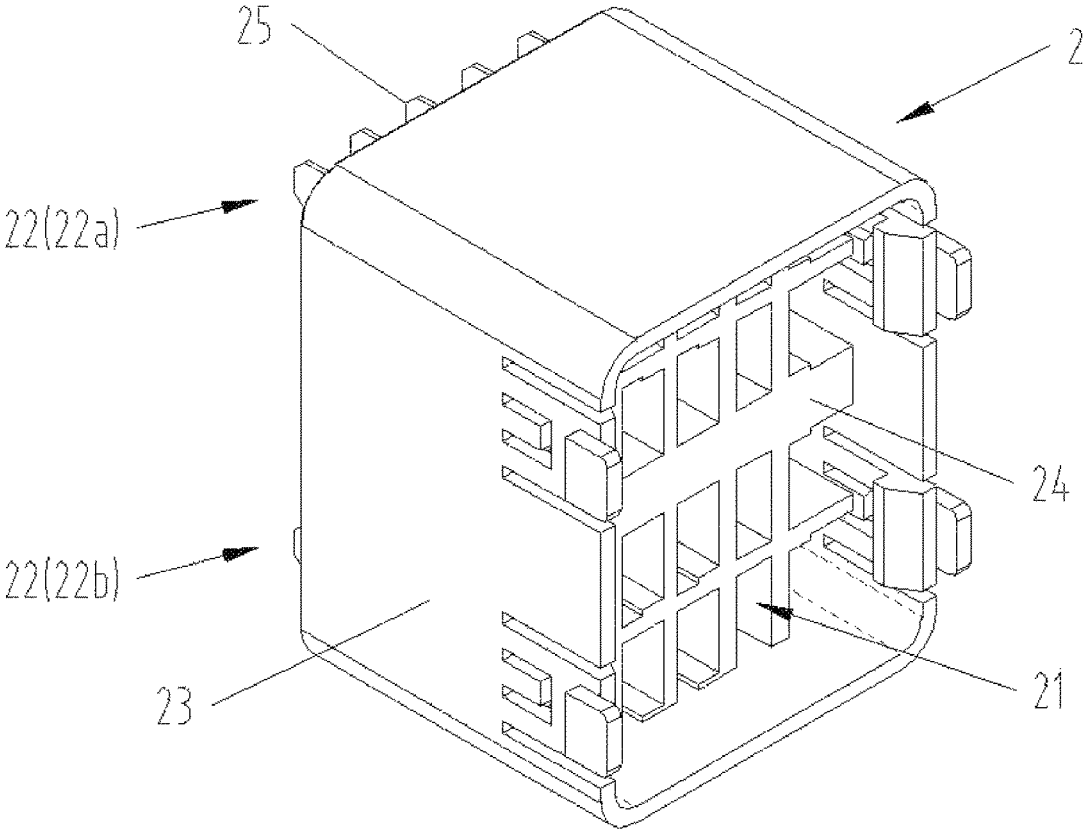
FIG. 4 is a schematic diagram of the connection module of the present invention.

As shown in FIG. 1, an embodiment of the modular combined socket of the present invention includes a circuit module 1, a connection module 2 and at least two socket modules 3. As shown in FIG. 2, the line module 1 is provided with a connection module interface 11 and a socket interface 12. Both the connection module interface 11 and the socket interface 12 have at least four connection points, and the connection module interface 11 and the socket interface 12 are arranged between at least four mutually insulated circuits in the circuit module 1 that are connected to form at least four conductive paths. As shown in FIG. 4, the connection module 2 is provided with a power interface 21 and a line module interface 22. The power interface 21 and the line module interface 22 also have at least four connection points. The power interface 21 and the line module interface 22 include at least four mutually insulated circuits in the connection module 2 which are connected to form at least four conductive paths. The connection module 2 can be connected to the power supply system through the power interface 21 and connected to the connection module interface 11 of the line module 1 through the line module interface 22 to form at least four conductive paths from the power supply system to the socket interface 12.

Figure 6:
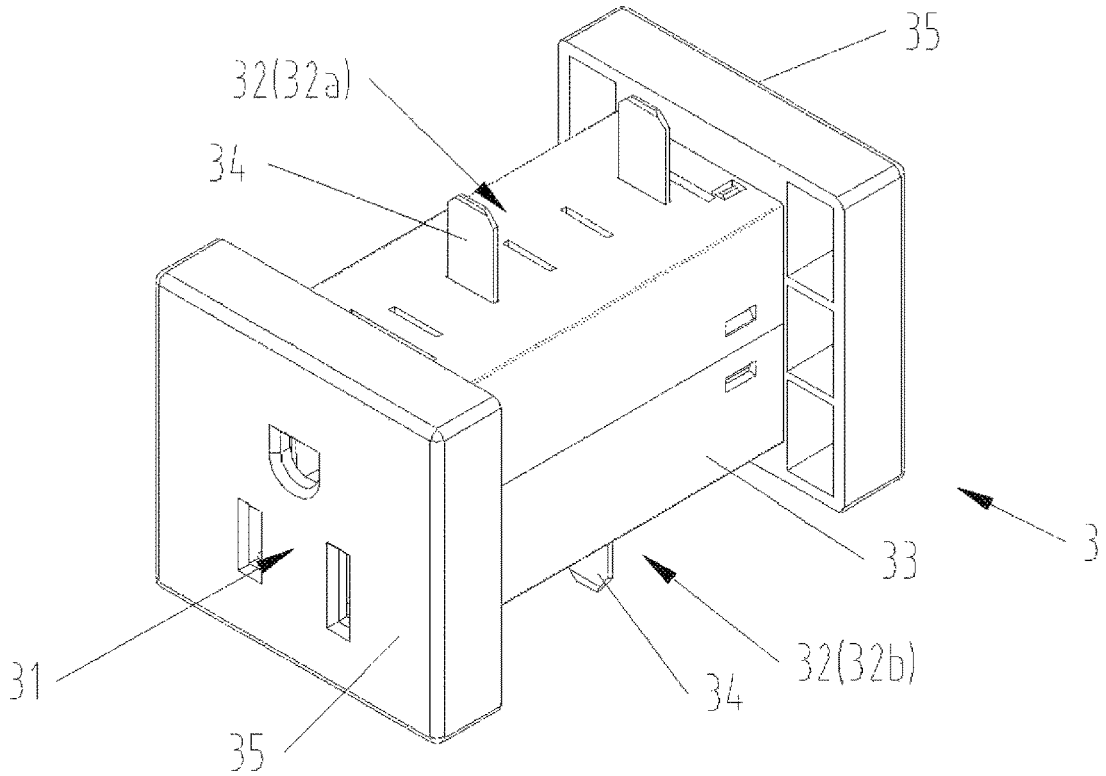
FIG. 6 is a schematic diagram of a socket module of the present invention.
Figure 17:
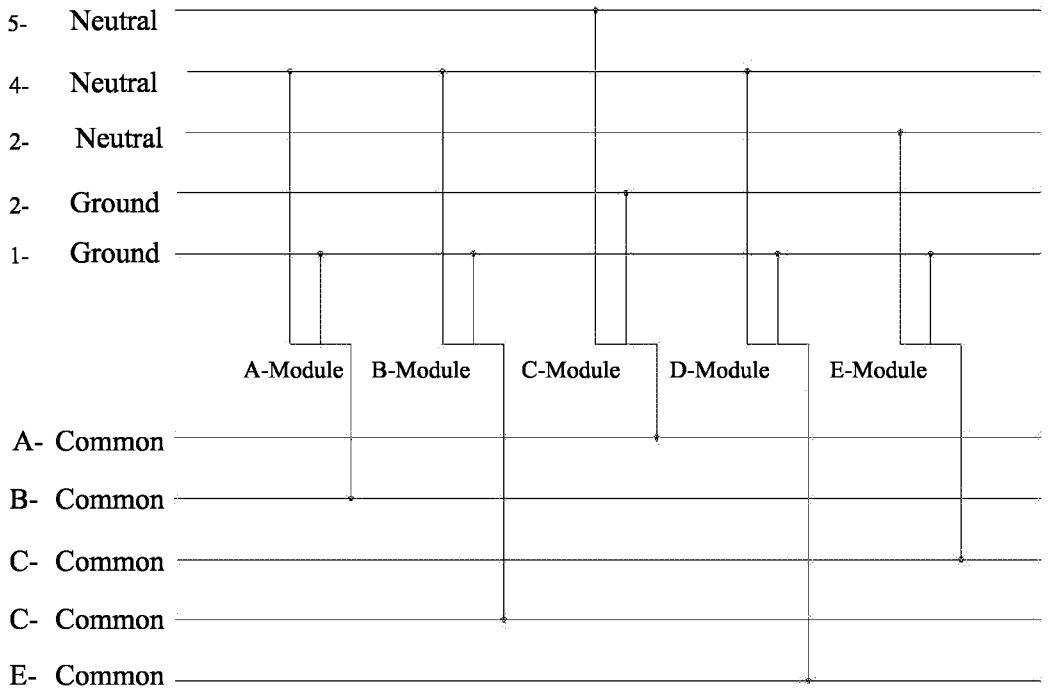
FIG. 17 is a schematic diagram of the power circuit of the modular combined socket of the present invention.

In the present invention, the specific number of conductive paths is determined according to the type and number of electrical appliances, which can be four, eight or ten, or other possible numbers. When setting four conductive paths, you can use two of them to connect to the live wire, one to the neutral wire, and one to ground. When using eight conductive paths, you can use four of them to connect to the live wire, two to the neutral wire, and two of the ground wires. When ten conductive paths are used, as shown in FIG. 17, five of them can be used to connect to the live wire, three to the neutral wire, and two to ground. Of course, other possible connections can also be used. As shown in FIG. 6, the socket module 3 is provided with a power output socket 31 and a line interface 32, and the power output socket 31 and the line interface 32 are connected to each other through a connection line provided in the socket module 3. The power output socket 31 may be a standard two-hole socket, a standard three-hole socket, or other types of standard sockets. According to the different regions of use, the socket standards of different regions can also be used. Depending on the type of the power output socket 31, different numbers of connection lines are used to connect to the line interface 32. The line interface 32 can be connected to the socket interface 12 on the line module 1, and the power output socket 31 can be connected to different conductive paths of the line module 1, so that the different power output sockets 31 in the modular combined socket of the present invention can be It is connected to different live wires, neutral wires and/or ground wires of the power supply system to increase the total carrying capacity of the combined socket and reduce the mutual interference between electrical appliances connected to different power output sockets 31.

In some embodiments of the modular socket of the present invention, as shown in FIG. 6, the socket module 3 is square in shape. Each socket module 3 is provided with two power output sockets 31, and the two power output sockets 31 are arranged on a pair of opposite faces of the socket module 3. And two power output sockets 31 are connected to the same line interface 32. In this way, one socket module 3 can provide two power output sockets 31 for the simultaneous use of two electrical appliances, so that the modular combined socket of the present invention can supply power for more electrical appliances.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Figure 3:
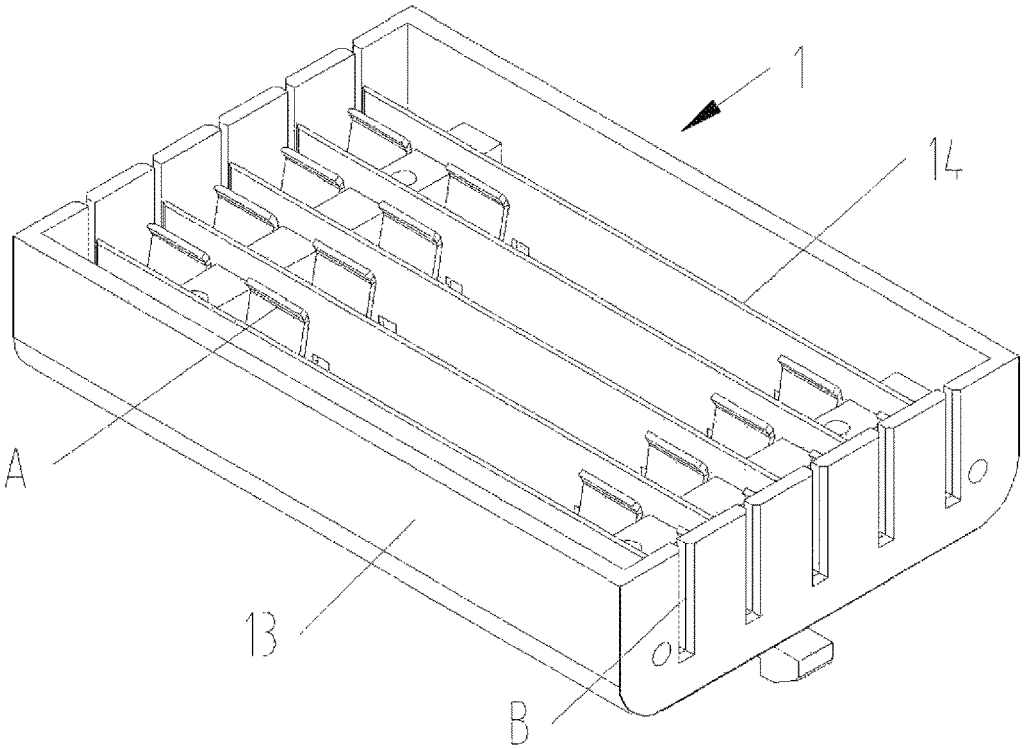
FIG. 3 is a schematic diagram of the internal structure of the circuit module of the present invention.

In some embodiments of the modular socket of the present invention, as shown in FIG. 2 and FIG. 3, two connection module interfaces 11 are provided on the line module 1, and the two connection module interfaces 11 are respectively provided on the line module 1 at both ends. The line module 1 is provided with two socket interfaces 12, and the two socket interfaces 12 are arranged on the same plane of the line module 1. The two connection module interfaces 11 and the two socket interfaces 12 are connected together by a circuit to form the same set of conductive paths. As shown in FIG. 1, a modular combined socket has two socket modules 3, and the two socket modules 3 are arranged in parallel on one side of the line module 1 and connect to the two socket interfaces on the line module 1 through their respective line interfaces 32, where 12 phases are connected to different conductive paths of the circuit module 1. A modular combined socket has two connection modules 2, the two connection modules 2 are respectively connected to both ends of the line module 1 and are connected to the connection module interface 11 on the line module 1 through the line module interface 22. The two power ports 21 on the connecting module 2 at the two ends can enable the modular combined socket of the present invention to be connected to the power supply system while being connected to another modular combined socket without occupying the power output socket 31. In one embodiment, multiple modular combination sockets can be used to expand the number of power output sockets 31.

Figure 13:
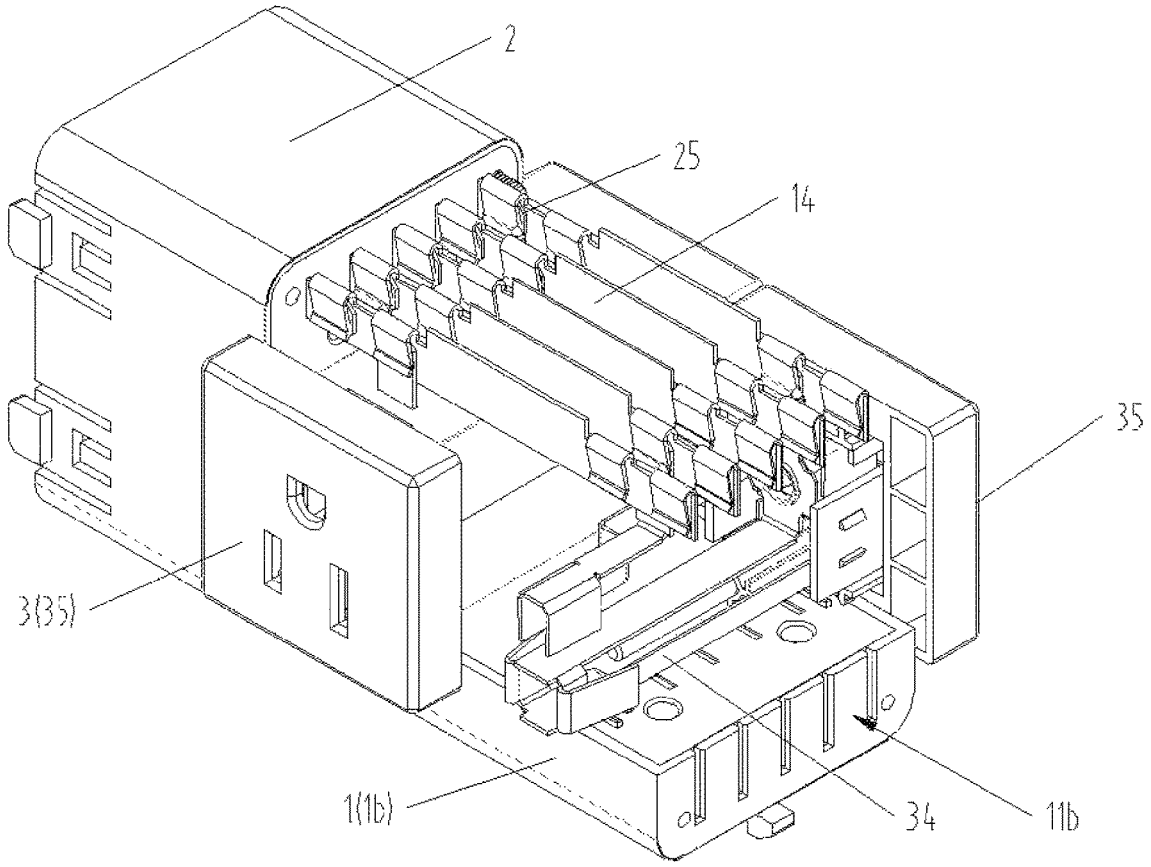
FIG. 13 is a schematic diagram (partial) of the internal structure of a modular combined socket of the present invention.

In some embodiments of the modular socket of the present invention, as shown in FIG. 1, FIG. 2 and FIG. 13, the circuit module 1 is composed of a first circuit module 1*a* and a second circuit module 1*b*. The first line module 1*a* and the second line module 1*b* are respectively arranged on the upper and lower sides of the socket module 3. The connection module interface 11 is composed of a first connection module interface 11*a* arranged on the first line module 1*a* and a second connection module interface 11*b* arranged on the second line module 1*b*; the socket interface 12 is composed of a first connection module interface 11*a* arranged on the first line module 1*a* the first socket interface 12*a* and the second socket interface 12*b* provided on the second circuit module 1*b* are formed.

Figure 5:
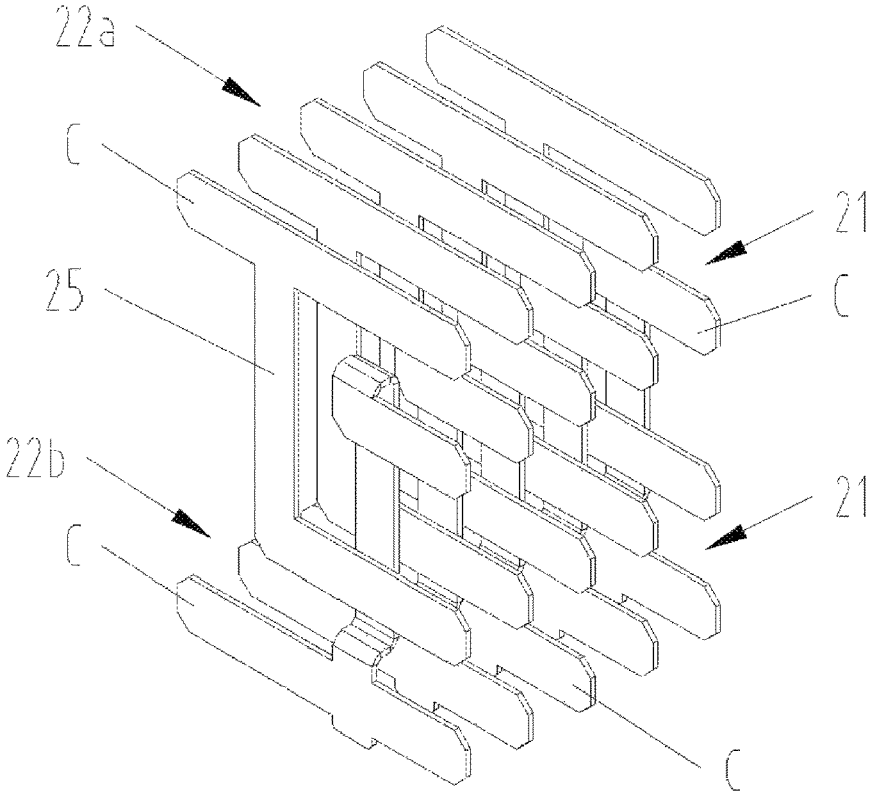
FIG. 5 is a schematic diagram of a conductive path of the connection module of the present invention.

As shown in FIG. 4 and FIG. 5, the different connection points of the line module interface 22 on the connection module 2 are divided into upper and lower groups with separate positions. The upper group forms the first line module interface 22*a*, and the lower group forms the first line module interface 22*a* and the second line module interface 22*b*.

As shown in FIG. 6, the line interface 32 on the socket module 3 is composed of a first line interface 32 *a* arranged on the upper side of the socket module 3 and a second line interface 32 *b* arranged on the lower side of the socket module 3. The power of the power supply system connected from the power interface 21 on the connection module 2 is connected to different conductive paths of the connection module 2 and is transmitted to different connection points of the line module interface 22. For example, the ground wire and the neutral wire are connected to the connection point of the first line module interface 22*a*, and the live wire is connected to the connection point of the second line module interface 22*b*. The first line module interface 22*a* is connected to the first connection module interface 11*a* on the first line module 1*a*, and the second line module interface 22*b* is connected to the second connection module interface 11*b* on the second line module 1*b*. As a result, the conductive paths in the first circuit module 1*a* form different ground and neutral wires of the power supply, and the conductive paths in the second circuit module 1*b* form different live wires of the power supply. The socket module 3 is connected to the first socket interface 12*a* on the first line module 1*a* through the first line interface 32*a*, is connected to the different neutral and ground lines of the power supply and is connected to the second line through the second line interface 32*b* the second socket interface 12*b* on the module 2*a* is connected to a different live wire of the power supply.

As a specific implementation of the modular socket of the present invention, as shown in FIG. 2 and FIG. 3, the circuit module 1 includes an insulated circuit casing 13, which can be made of plastic, bakelite or other various insulating materials. At least four-line conductors 14 are insulated from each other are arranged inside the line housing 13. The line conductors 14 can be made of copper strips, alloy strips or various other suitable conductive materials. Each line conductor 14 forms a power supply conductive path. At both ends of the line conductor 14, a socket A for circuit connection is provided. The middle part of the line conductor 14 is provided with two sockets A at intervals. The sockets A in the middle part of the different line conductors 14 are arranged on the side of the line conductor 14 at the corresponding location. The position corresponding to each socket A on the housing 13 is provided with a socket B for the socket to pass through. The socket B at both ends of the line module 1 and the socket A in the socket B, each form a connection module interface 11; the two sets of sockets B at different positions on the side of the line module 1 and the socket A in the socket B respectively form Two socket interfaces 12.

As a specific implementation of the modular socket of the present invention, as shown in FIG. 4 and FIG. 5, the connection module 2 includes an insulated connection housing 23, an insulated connection bracket 24 and at least four connection conductors 25. The connecting conductors 25 are insulated from each other and fixed on the connecting bracket 24, and the connecting bracket 24 together with the connecting conductor 25 are installed in the connecting shell 23. One end of the connecting conductor 25 passes through one side of the connecting housing 23 to form a plug C that can be plugged into the socket A, and the other end of the connecting conductor 25 forms a plug C in a slot preset on the connecting bracket 24. A plurality of plugs C protruding from the connection housing 23 at one end of the connection module 2 form a line module interface 22, and a plurality of plugs C located in the slot of the connection bracket 24 at the other end of the connection module 2 form a power interface 21. The connecting conductors 25 form a conductive path from the power interface 21 to the line module interface 22.

In some embodiments of the modular socket of the present invention, as shown in FIG. 4 and FIG. 5, the plugs C forming the line module interface 22 on the connection module 2 are divided into two groups, the upper and lower groups, which are separated from each other. The number of plugs C included can be the same or different. A set of plugs C located at the upper part of the connection module 2 forms a first line module interface 22*a*, and a set of plugs C located at the lower part of the connection module 2 forms a second line module interface 22*b*. In other embodiments, the other end of the connecting conductor 25 in the connection module 2 forms two mutually connected plugs C separated in position, and the two separated plugs C on each connecting conductor 25 are alternately insulated from each other. It is arranged to form two groups located at different positions on the upper and lower sides of the connecting module 2, and the plugs C of each group form a power interface 21. The two power interfaces 21 in the connection module 2 of this embodiment are connected to each other and can be simultaneously connected to two sets of power supply system circuits and/or power interfaces of other modular combined sockets. Increasing the power supply load or installing more modular sockets also enriches the connection modes between modular sockets.

Figure 14:
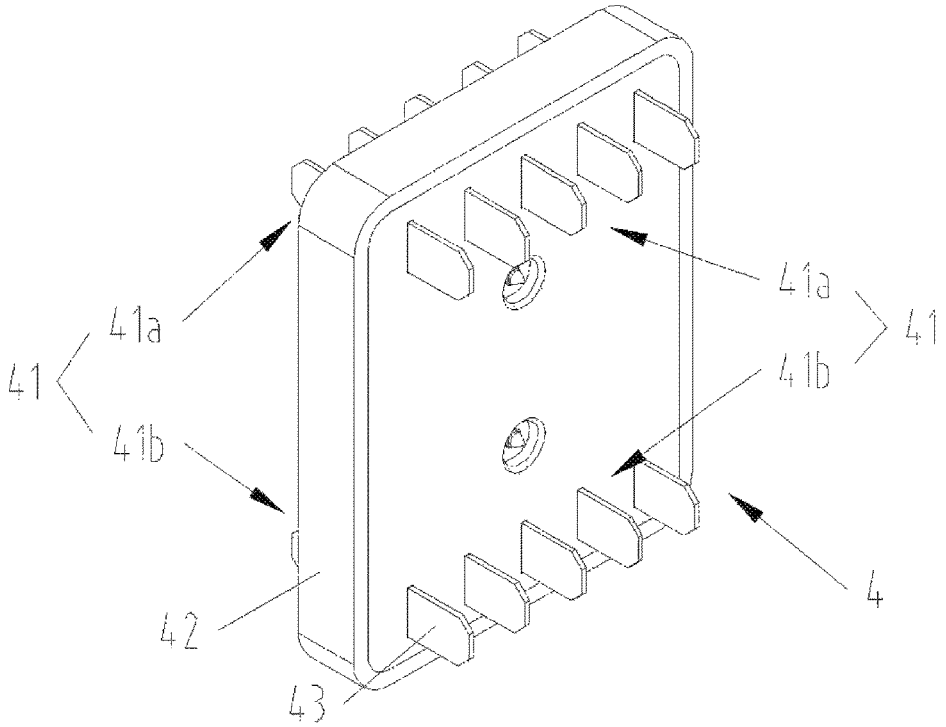
FIG. 14 is a schematic diagram of an intermediate module of the present invention.
Figure 15:
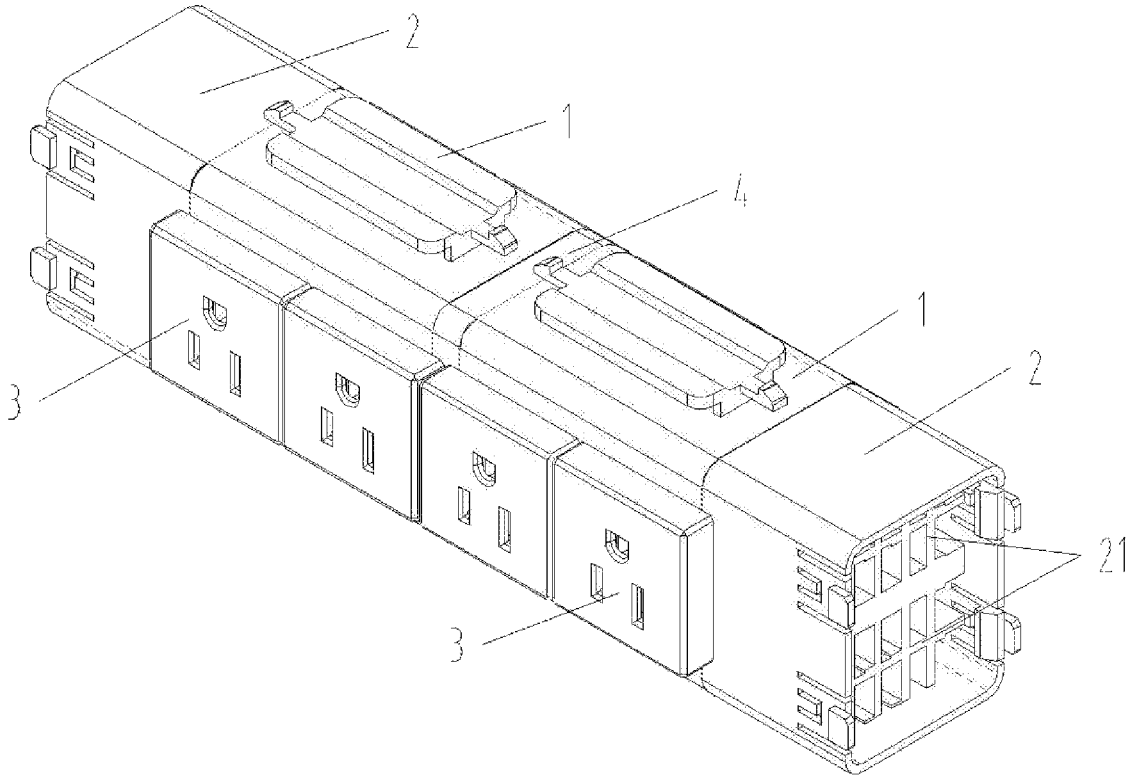
FIG. 15 is a schematic diagram of another modular combined socket of the present invention.
Figure 16:
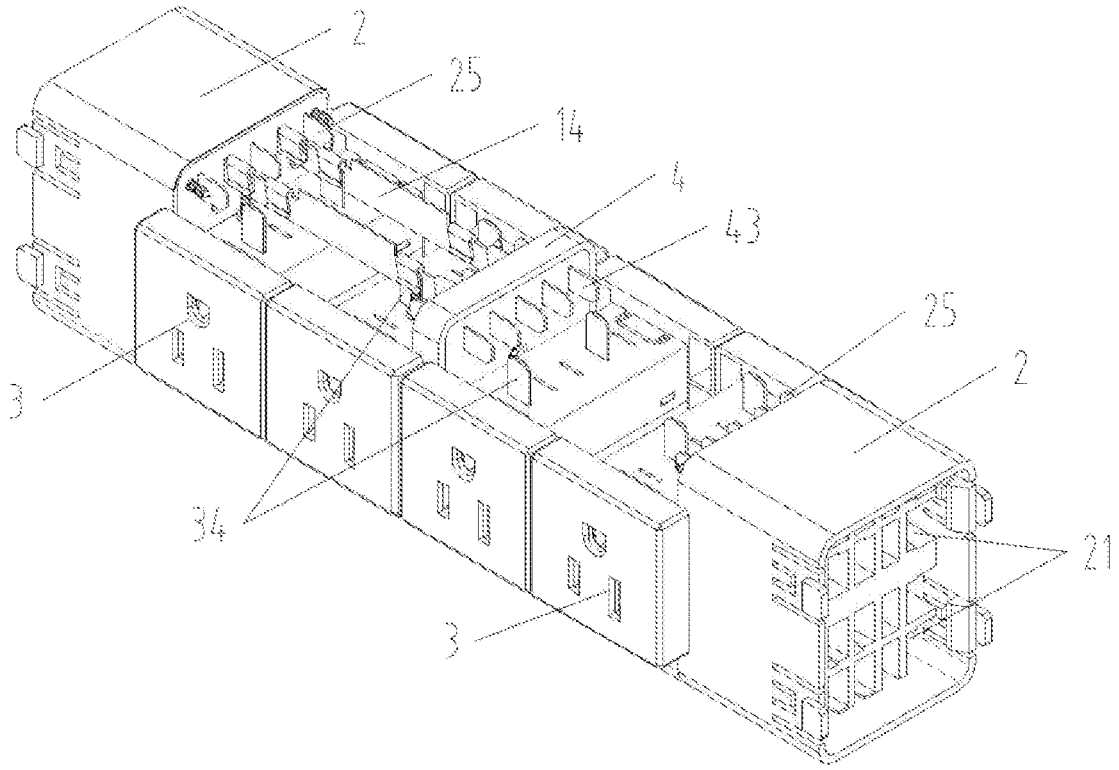
FIG. 16 is a schematic diagram (partial) of the internal structure of another modular combined socket of the present invention.

In some embodiments of the modular socket of the present invention, as shown in FIG. 14, the modular socket of the present invention further includes an intermediate connector module 4. The intermediate connector module 4 includes an intermediate connector seat 42 and a plurality of connector conductors 43. The joint conductors 43 are insulated from each other and are arranged on the intermediate joint seat 42. Two ends of the joint conductors 43 extend from the two ends of the intermediate joint seat 42 to form the middle connection interfaces 41 at the two ends of the middle joint module 4 respectively. The intermediate interface 41 can be connected to the connection module interface 11 on the line module 1. Compatible with different connection module interfaces 11, a plurality of joint conductors 43 can also be arranged in different positions separated from each other up and down in the middle joint seat 42. The two sets of joint conductors 43 at different positions up and down respectively form the first middle interface 41*a* and the second middle interface 41*b*. The first intermediate interface 41*a* is used to connect with the first connection module interface 11*a* on the first line module 1*a*, and the second intermediate interface 41*b* is used to connect with the second connection module interface 11*b* on the second line module 1*b*. A modular combined socket with an intermediate connector module 4 is shown in FIGS. 15 and 16. Both ends of the intermediate connector module 4 are connected to the circuit module 1, and the other end of the circuit module 1 is connected to the connection module 2. Two plug modules 3 are connected to the line modules 1 at both ends of the intermediate connector module 4. In this way, four socket modules 3 can be set on a modular combined socket. When the socket module 3 with two power output sockets 31 is used, it can also provide eight power output sockets 31 for up to eight power consumption. The electrical appliances are supplied simultaneously. Using two intermediate connector modules 4, a modular combined socket with six plug modules 3 can be assembled. and many more.

Figure 7:
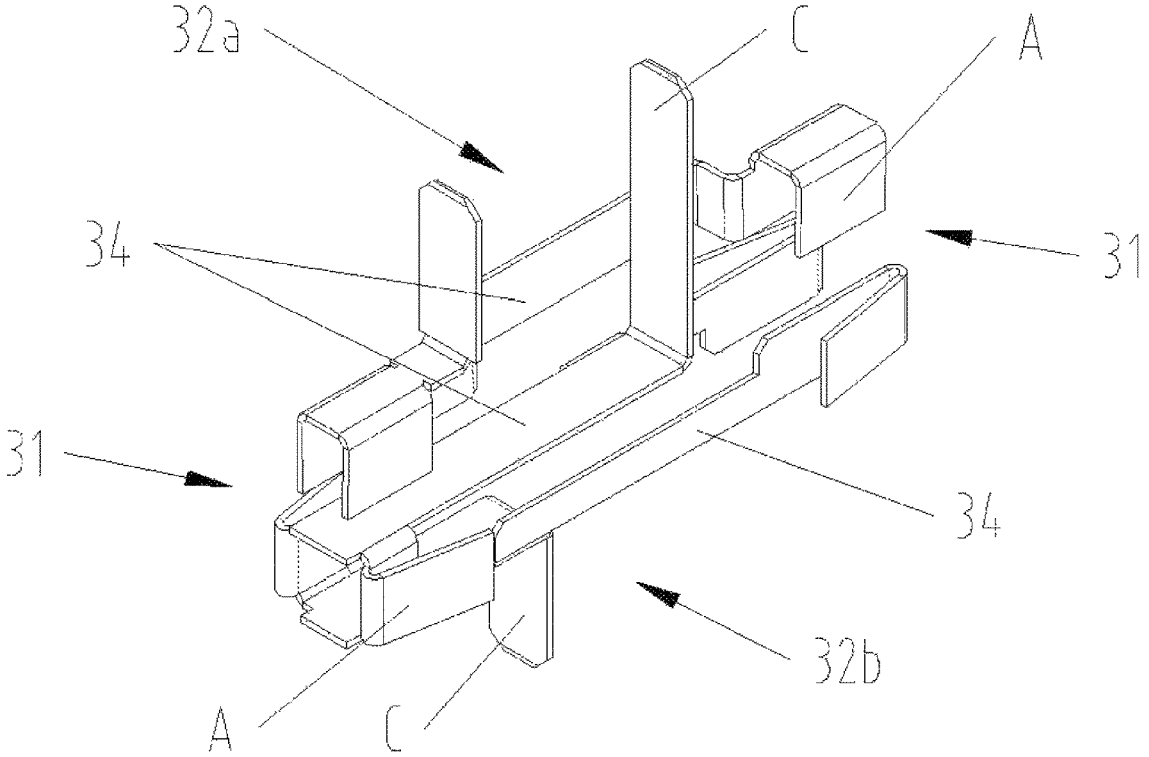
FIG. 7 is a schematic diagram of the conductive path of the socket module of the present invention.

In some embodiments of the modular socket of the present invention, as shown in FIG. 6 and FIG. 7, the socket module 3 includes a socket housing 33, a socket conductor 34 and a socket panel 35. The socket housing 33 is made of insulating material. The socket panel 35 is arranged on the side of the socket housing 33. One socket panel 35 can be provided on one side of the socket housing 33, or on both sides of the socket housing 33. A socket panel 35. The socket panel 35 is provided with a standard power output socket 31. The socket housing 33 is provided with socket conductors 34 with the same number of sockets as the power output socket 31. One end of the socket conductor 34 protrudes from the other side of the socket housing 33 to form a plug C. The other end of the socket conductor 34 is connected to a socket A in the socket of the power output socket 31 on the socket panel 35 to form a socket, the conductive path from socket A to plug C. The socket A can also be formed by a part of the socket conductor 34 to form a conductive path integrally connected with the plug C. The socket A connected to each socket conductor 34 forms a power supply contact of the standard power output socket 31, and the plug C of each socket conductor 34 forms a line interface 32. The circuit interface 32 can relate to the socket interface 12 on the circuit module 1 to form an electrical connection between the plug C and different conductive paths in the circuit module 1 to connect the power output socket 31 to different conductive paths in the circuit module 1.

To adapt to the different setting forms of the circuit module 1, the plugs C of different socket conductors 34 can also be arranged to extend from the upper and lower surfaces of the socket housing 33, for example, those connected to the neutral and ground wires of the power output socket 31 The plug C of the socket conductor 34 protrudes from the upper surface of the socket housing 33, and the plug C of the socket conductor 34 connected to the live wire of the power output jack 31 protrudes from the bottom of the socket housing 33. The plugs C protruding from the upper and lower surfaces respectively form a first line interface 32*a* and a second line interface 32*b*. The first line interface 32*a* can be connected to the first socket interface 12*a* on the first line module 1*a*, and the second line interface 32*b* can be connected to the second socket interface 12*b* on the second line module 1*b*.

To connect the power output sockets 31 on different socket modules 3 to different conductive paths of the circuit module 1, the plugs C of the socket conductors 34 on different socket modules 3 are arranged at different positions.

For example, a modular combined socket of the present invention is shown in FIG. 1 and is composed of a first circuit module 1*a*, a second circuit module 1*b*, two connection modules 2 and two socket modules 3. Two socket modules 3 are arranged side by side. The first circuit module 1*a* and the second circuit module 1*b* are respectively arranged on the upper and lower sides of the socket module 3. The first socket interface 12*a* on the first circuit module 1*a* and the first circuit on the socket module 3 The interface 32*a* is connected, and the second socket interface 12*b* on the second line module 1*b* is connected with the second line interface 32*b* on the socket module 3. The two connection modules 2 are respectively arranged at the left and right ends of the first line module 1*a*, the second line module 1*b* and the two socket modules 3, and are connected to the first line module through the first line module interface 22*a* and the second module interface 22*b* respectively. The first connection module interface 11*a* and the second connection module interface 11*b* at both ends of the 1*a* and the second line module 1*b* are connected. Each of the two socket modules 2 contains ten conductive paths, and both the first circuit module 1*a* and the second circuit module 1*b* contain five conductive paths.

As shown in FIG. 17, the five conductive paths in the first circuit module 1*a* are connected to the neutral line or the ground line of the power supply system, respectively forming the ground line 1, the ground line 2, the neutral line 3, the neutral line 4 and the neutral line 5. And are connected with the connection points arranged in sequence in the first socket interface 12*a*; the five conductive paths in the second circuit module 1*b* are connected to the live wires of the power supply system to form live wires 1, live wires 2, live wires 3, live wires 4 and The live wire 5 is connected to the connection points arranged in sequence in the second socket interface 12*b*. The three-eye socket module 3 is divided into five different models namely Type A, Type B, Type C, Type D and Type E.

Figure 8:
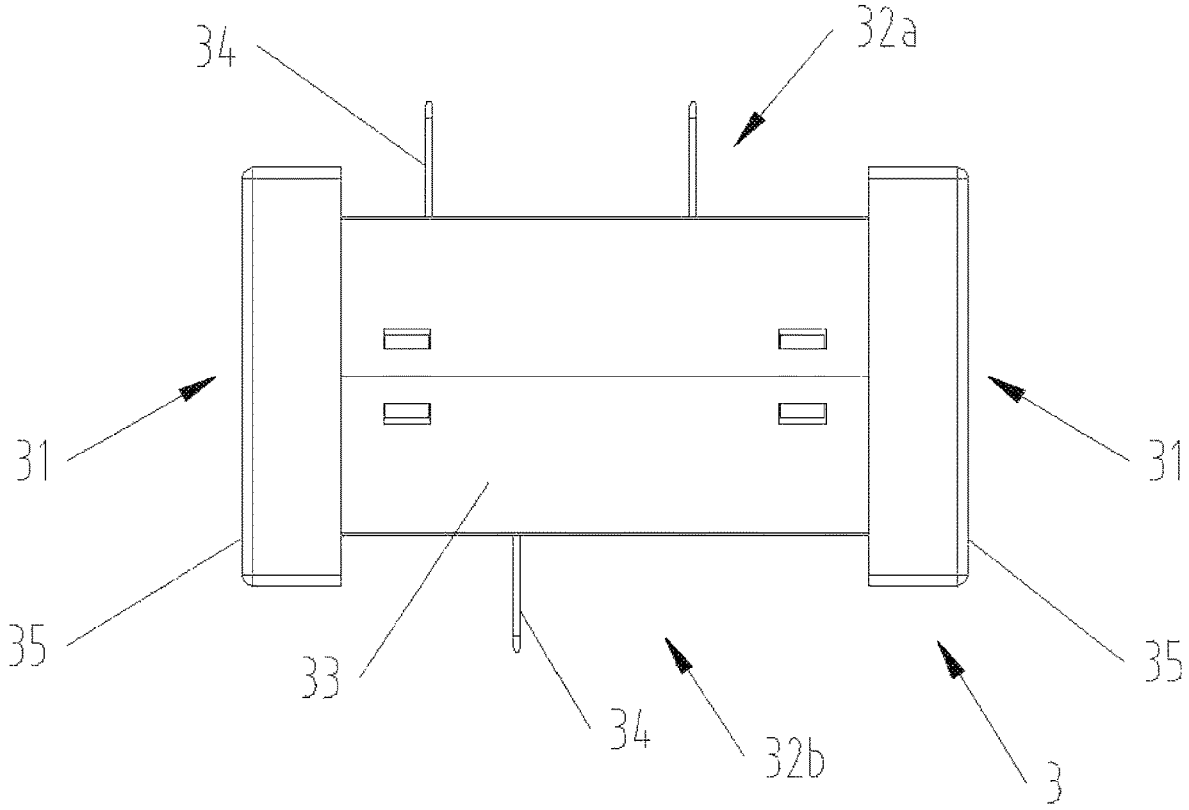
FIG. 8 is a schematic diagram of the A-type socket module circuit interface of the present invention.

As shown in FIG. 8 and FIG. 17, the first line interface 32*a* on the Type A socket module 3, The plug of the socket conductor 34 is set at the position corresponding to the ground wire 1 and the neutral wire 4, and the plug of the socket conductor 34 in the second line interface 32*b* is set at the position corresponding to the live wire 2, so that the socket of the A-type module. Module 3 is connected to live wire 2, neutral wire 4 and ground wire 1.

Figure 9:
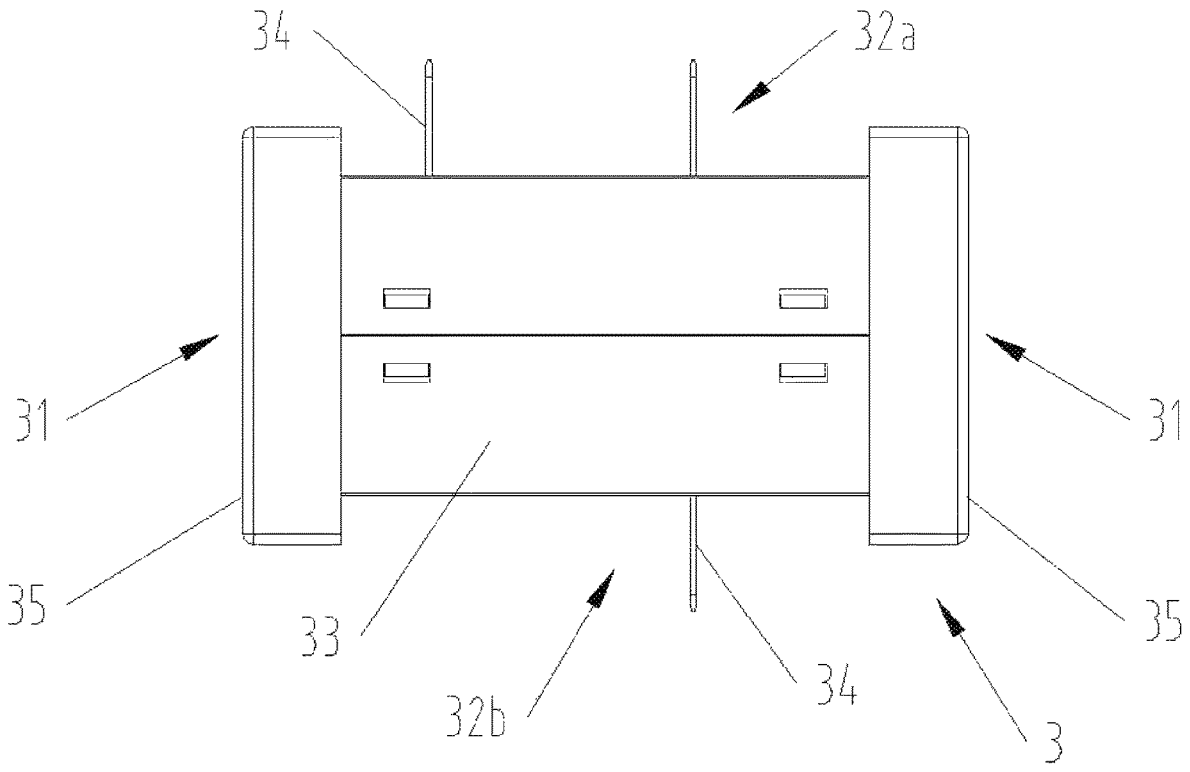
FIG. 9 is a schematic diagram of the line interface of the B-type socket module of the present invention.

As shown in FIG. 9 and FIG. 17, in the first line interface 32*a* on the B-type socket module 3, the plug of the socket conductor 34 is set at a position corresponding to the ground wire 1 and the neutral wire 4, and in the second line interface 32*b* the plug of the socket conductor 34 is arranged at a position corresponding to the live wire 4, so that the socket module 3 of the B-type module is connected to the live wire 4, the neutral wire 4 and the ground wire 1.

Figure 10:
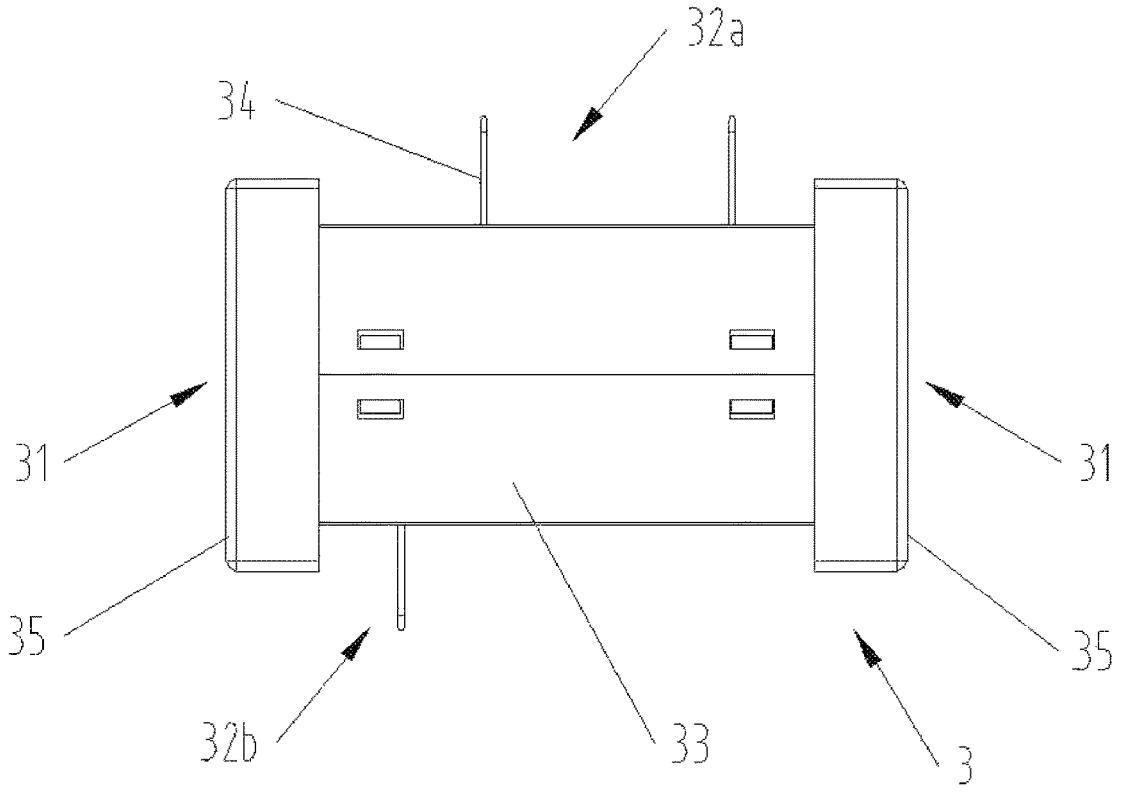
FIG. 10 is a schematic diagram of the circuit interface of the C-type socket module of the present invention.

As shown in FIG. 10 and FIG. 17, in the first line interface 32*a* on the C-type socket module 3, the plug of the socket conductor 34 is set at a position corresponding to the ground wire 2 and the neutral line 5, and the second line interface 32*b*. The plug of the socket conductor 34 is arranged at a position corresponding to the live wire 1, so that the socket module 3 of the C-type module is connected to the live wire 1, the neutral wire 5 and the ground wire 2.

Figure 11:
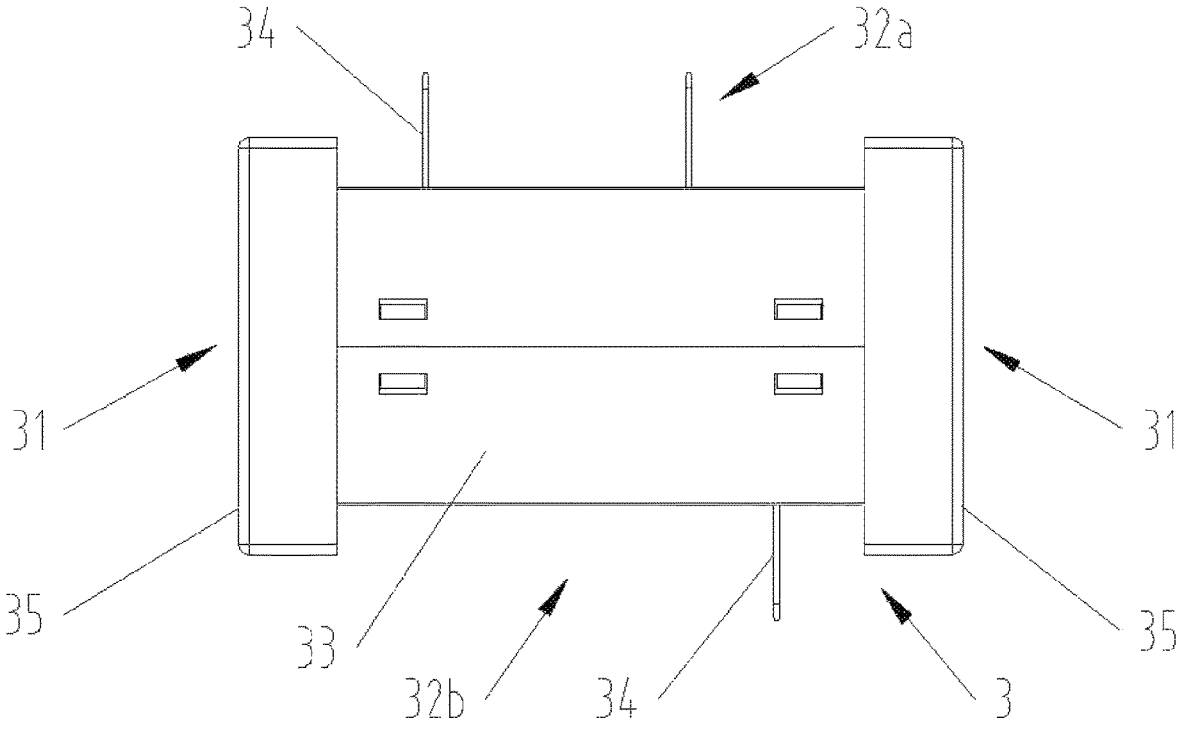
FIG. 11 is a schematic diagram of the D-type socket module circuit interface of the present invention.

As shown in FIG. 11 and FIG. 17, in the first line interface 32*a* on the D-type socket module 3, the plug of the socket conductor 34 is set at a position corresponding to the ground wire 1 and the neutral line 4, and in the second line interface 32*b*. The plug of the socket conductor 34 is arranged at a position corresponding to the live wire 5, so that the socket module 3 of the D-type module is connected to the live wire 5, the neutral wire 4 and the ground wire 1.

Figure 12:
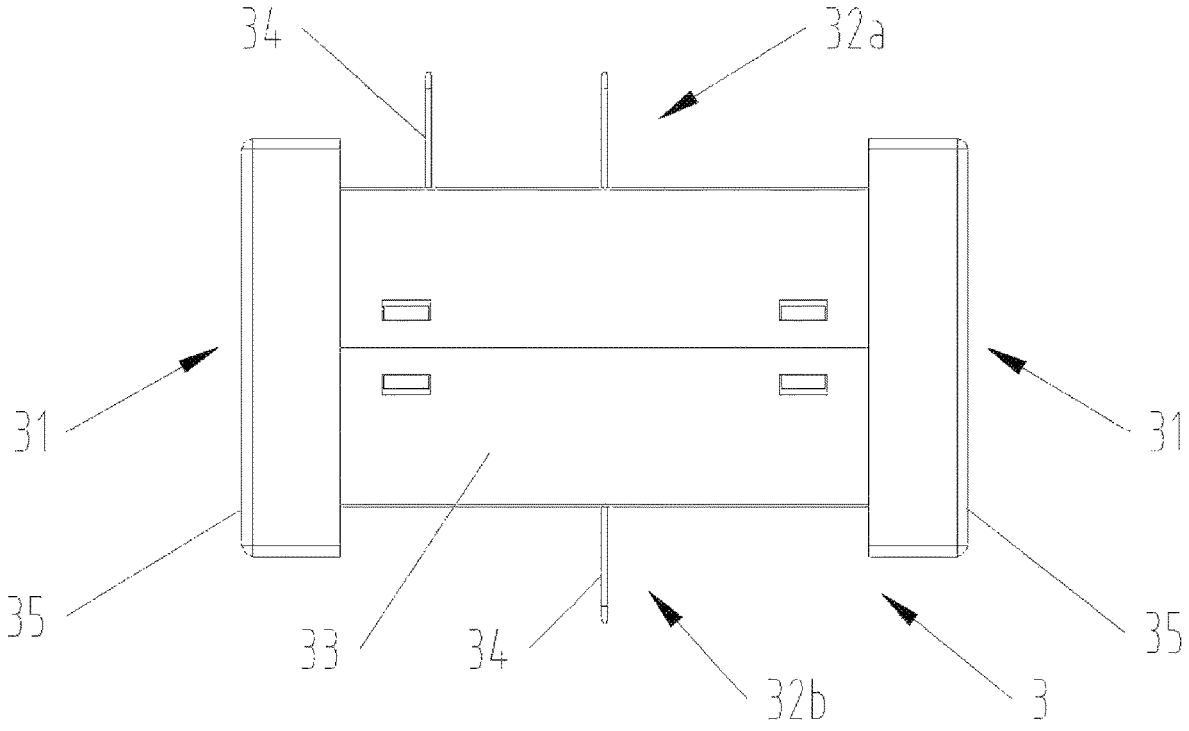
FIG. 12 is a schematic diagram of the circuit interface of the E-type socket module of the present invention.

As shown in FIG. 12 and FIG. 17, in the first line interface 32*a* on the E-type socket module 3, the plug of the socket conductor 34 is set at a position corresponding to the ground wire 1 and the neutral wire 3, and in the second line interface 32*b*. The plug of the socket conductor 34 is arranged at a position corresponding to the live wire 3 so that the socket module 3 of the E-type module is connected to the live wire 3, the neutral wire 3 and the ground wire 1. The modular combined socket of the present invention can be combined with any of the three-eye socket modules 3 of type A, B, C, D and E. For example, in a modular type with two socket modules 3 Combination sockets can be used in different combinations of type A, type A, type B, type B, and type C. Of course, the socket module 3 can also be provided with a standard two-eye power output socket 31, and the two conductive paths of the two-eye power output socket 31 can also be connected to different live and neutral wires. Different modular combined sockets can use different types of socket modules 3. However, when the number of socket modules 3 provided is large, it is not appropriate to use too many socket modules 3 of the same type.

Installing different types of socket modules 3 on the same or different modular sockets connected to each other can make electrical appliances connected to different socket modules 3 connect to different live, neutral, or ground conductive paths, the electric current required by the electric appliance passes through different conductive paths, which greatly improves the load bearing capacity of the modular combined socket. At the same time, since the live, neutral, and ground wires of the C-type socket module 3 are all connected to separate conductive paths and do not share the conductive paths with other types of socket modules 3, electrical appliances connected to the C-type socket module 3 It can form a greater degree of isolation from electrical appliances connected to other types of socket modules 3 to prevent interference caused by the work of other electrical appliances.

Figure 18:
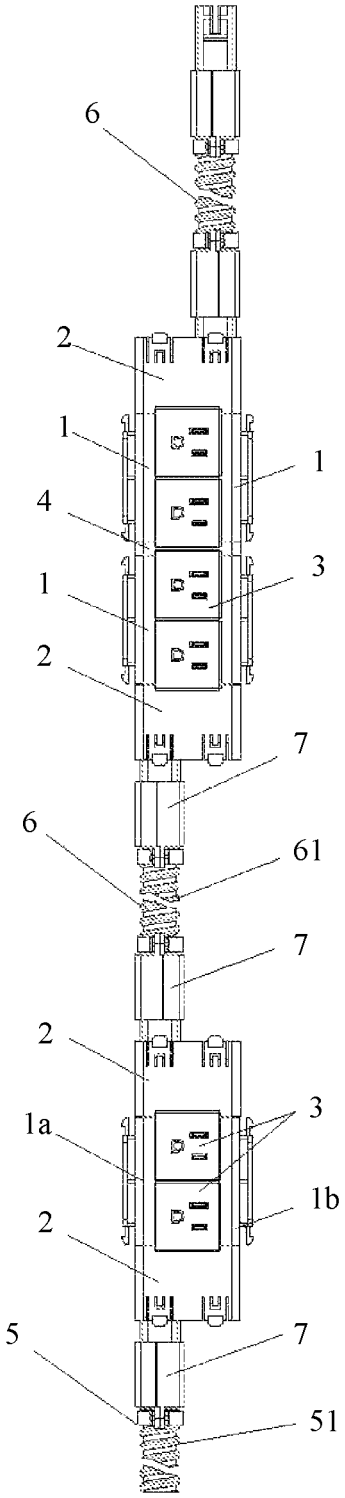
FIG. 18 is a schematic diagram of a modular power supply assembly of the present invention.

In the modular power supply assembly of the present invention, the modular combined socket of any of the above-mentioned embodiments can be used. In some embodiments of the modular power assembly, as shown in FIG. 18, a power cable 5, a connecting cable 6 and the modular combined socket are used. There are at least two modular sockets. The power cable 5 is a cable with power transmission wires with no less than the number of conductive channels in the modular combined socket. One end of the power cable 5 is connected to the power connector 7 and is connected to the power interface 21 of a modular socket through the power connector 7, and the other end can be connected to the power supply system, to be able to connect different modular sockets. The conductive channel is connected to the corresponding power supply circuit of the power supply system. The connecting cable 6 is also a cable with power transmission wires with no less than the number of conductive channels in the modular combined socket. Both ends of the connecting cable 6 are connected to a power connector 7 respectively. One end of the connecting cable 6 is connected to the other power interface 21 of the modular socket directly connected to the power supply system through the power connector 7, and the other end is connected to the power interface 21 of the other modular socket through the power connector 7 Connect to connect another modular socket to the power supply system to provide more power output sockets 31. When the modular power assembly of the present invention uses multiple modular sockets, multiple connecting cables 6 are also required to connect the modular sockets to each other and are connected to the power supply system through the power cable 5. Due to the high load capacity of the modular combined socket of the present invention, multiple modular combined sockets can be connected to each other offering more flexibility. Another type of socket module can be replaced at any time according to the actual situation in order to meet actual needs such as providing more power output nodes, providing more power transmission distance, and providing a higher power supply load. In the modular power supply assembly of the present invention, each modular combined socket can form an expansion source, which can be expanded in various directions according to the required position. In use, multiple modular sockets can be connected end-to-end in a line to transmit power to a longer distance. Further, multiple modular sockets can also be connected in a branch to transmit power to different directions, and their specific connection forms to facilitate the connection of electrical appliances.

Description of Reference Signs

| | | | |
|---|---|---|---|
| 1 | Line module | 1a | First line module |
| 1b | Second line module | 11 | Connection module interface |
| 11a | First connection module interface | 11b | Second line module interface |
| 12 | Socket interface | 12a | The first socket interface |
| 12b | Second socket interface | 13 | Line shell |
| 14 | Line conductor | 2 | Connection module |
| 21 | Power connector | 22 | Line module interface |
| 22a | First line module interface | 22b | Second line module interface |
| 23 | Connect the shell | 24 | Connect the bracket |
| 25 | Connecting conductor | 3 | Socket module |
| 31 | Power output jack | 32 | Line interface |
| 32a | First line interface | 32b | Second line interface |
| 33 | Socket housing | 34 | Socket conductor |
| 35 | Socket panel | 4 | Intermediate connector module |
| 41 | Middle interface | 41a | The first intermediate interface |
| 41b | Second intermediate interface | 42 | Intermediate substrate |
| 43 | Intermediate conductor | 5 | Power cable |
| 6 | connecting cables | 7 | Power connector |

Thus, the present invention is direct to a modular combined socket, characterized by comprising a circuit module (1), a connection module (2) and at least two socket modules (3), the circuit module (1) includes at least four conductive paths connected to each other The connection module interface (11) and the socket interface (12) of the connection module (2) include a power interface (21) and a line module interface (22) with at least four conductive paths connected to each other, and the connection module (2) It can be connected to the connection module interface (11) of the line module (1) through the line module interface (22), and the socket module (3) includes a power output socket (31) and a line interface (32) connected to each other), different said socket modules (3) can be connected to different conductive paths of said socket interface (12) through respective said line interfaces (32).

The modular combined socket is characterized in that the socket module (3) is square, and each socket module (3) includes two power output sockets (31), The two power output sockets (31) are arranged on a pair of opposite surfaces of the socket module (3).

The modular combined socket is further characterized in that there are two connection module interfaces (11), which are respectively arranged at both ends of the line module (1), and the socket interface (12)) There are two, and the two socket interfaces (12) are arranged on the same plane of the circuit module (1); there are two socket modules (3), and the two socket modules (3) are arranged in parallel Are respectively connected to the two socket interfaces (12) through the line interface (32), and there are two connection modules (2), which are respectively connected to both ends of the line module (1).

The modular combined socket is further characterized in that the line module (1) comprises a first line module (1*a*) and a second line module (1*b*), and the connection module interface (11) It includes a first connection module interface (11*a*) and a second connection module interface (11*b*). The socket interface (12) includes a first socket interface (12*a*) and a second socket interface (12*b*). The first connection module interface (11*a*) and the first socket interface (12*a*) are located on the first line module (1*a*), and the second connection module interface (11*b*) and the second socket interface (12*b*) are located on the second On the line module (1*b*); the line interface (32) includes a first line interface (32*a*) and a second line interface (32*b*), the first line interface (32*a*) and the second line interface (32*b*) are respectively provided On the other pair of opposite faces of the socket module (3); the socket module (3) is connected to the first socket interface (12*a*) through the first line interface (32*a*) and the second The connection between the second line interface (32*b*) and the second socket interface (12*b*) is arranged between the first line module (1*a*) and the second line module (1*b*); the line module interface (22) includes a A line module interface (22*a*) and a second line module interface (22*b*), the first line module interface (22*a*) is connected to the first connection module interface (11*a*), the second line module interface (22*b*)) Is connected to the second connection module interface (11*b*).

The modular socket is further characterized in that the circuit module (1) comprises a circuit housing (13) and at least four mutually insulated circuits arranged in the circuit housing (13) A conductor (14), each of the line conductors (14) forms a conductive path; both ends of the line conductor (14) are provided with a socket, and two sockets are provided at the corresponding position on the side; the line The sockets at both ends of the module (1) respectively form the connection module interface (11), and the sockets at different positions on the side respectively form the socket interface (12).

The connecting module (2) includes a connecting shell (23), a connecting bracket (24) and at least four connecting conductors (25); each of the connecting conductors (25) is mutually insulated and fixed on the connecting bracket (24), And set in the connecting housing (23) together with the connecting bracket (24), each connecting conductor (25) forms a conductive path, and one end of the connecting conductor (25) forms a through The other end of the plug of the connection housing (23) forms a plug located in the connection bracket (24), and the exposed plug at one end of the connection module (2) forms the line module interface (22), The plug at the other end in the connecting bracket (24) forms the power interface (21).

The modular combined socket is characterized in that the plugs of the line module interface (22) are divided into two groups with different positions, forming a first line module interface (22*a*) and a second line Module interface (22*b*).

The other end of each connecting conductor (25) forms two mutually connected plugs separated in position, and two power interfaces (21) are formed at the other end of the connecting module (2).

The modular combined socket according further comprises an intermediate joint module (4), and two ends of the intermediate joint module (4) are provided with interconnecting intermediate interfaces (41), the intermediate interfaces (41) at both ends are all suitable for connecting with the connection module interface (11).

The modular combined socket is further characterized in that the socket module (3) comprises a socket housing (33), a socket conductor (34) and a socket panel (35). The socket conductor (34) is arranged in the socket housing (33), the socket panel (35) is arranged on the side of the socket housing (33), and the socket panel (35) is provided with a standard A power output socket (31), one end of the socket conductor (34) protrudes from different positions of the socket housing (33) to form the line interface that can be connected to different connection channels of the socket interface (12) (32), the other end is connected with the power output socket (31).

Further, the present invention includes a modular power supply assembly that comprises a power cable (5), a connecting cable (6) and at least two modular combined sockets, one end of the power cable (5) A power connector (7) is connected, and the other end can be connected to the power supply system; both ends of the connecting cable (6) are connected to a power connector (7); the power connector (7)) can be connected to the power interface (21) on the modular combination socket; the power cable (5) is connected to one of the modular combination sockets, and each modular combination socket passes through all the connecting cables (6) are connected to each other.

In the description of this specification, reference to the terms "one embodiment", "an embodiment", "some embodiments" and "a specific embodiment" means that the specific feature, structure, or feature described in conjunction with the embodiment includes In at least one embodiment of the present invention. In this specification, the schematic representation does not necessarily refer to the same embodiment.

The preferred embodiments of the present invention are described in detail above with reference to the accompanying drawings, but the present invention is not limited thereto. Within the scope of the technical concept of the present invention, a variety of simple modifications can be made to the technical solution of the present invention, including individual specific technical features combined in any suitable manner. To avoid unnecessary repetition, the present invention has various possibilities. The combination method will not be explained separately. However, these simple modifications and combinations should also be regarded as the disclosed content of the present invention, and all belong to the protection scope of the present invention.

I claim:

1. A modular combined socket comprising:

at least two socket modules;

a circuit module having at least four conductive paths;

a connection module having a connection module interface and a socket interface for interconnecting modular combined sockets;

a socket interface connected to the connection module interface through a line module interface; and wherein each socket module includes a power output socket and a line interface connected to each other, such that different socket modules can be connected to different conductive paths of the socket interface through respective line module interfaces.

2. A modular combined socket as in claim 1, wherein the at least four conductive paths are independent electrical power circuits.

3. A modular combined socket as in claim 1, wherein the circuit module includes a plurality of line conductors for selecting the at least our conductive paths.

4. A modular combined socket as in claim 1, wherein the circuit module connects to the top of the at least two socket modules.

5. A modular combined socket as in claim 1, wherein the connection module connects to an end of the modular combined socket.

6. A modular combined socket comprising:

at least two socket modules;

a circuit module having at least four conductive paths connected to the at least two socket modules for connecting multiple circuit modules to different power circuits;

a connection module for interconnecting a plurality of modular combined sockets to one another; and wherein the at least two socket modules plug into a socket interface in the circuit module.

7. A modular combined socket as in claim 6, wherein the at least four conductive paths are independent electrical power circuits.

8. A modular combined socket as in claim 6, wherein the circuit module includes a plurality of line conductors for selecting the at least our conductive paths.

9. A modular combined socket as in claim 6, wherein the circuit module connects to the top of the at least two socket modules.

10. A modular combined socket as in claim 6, wherein the connection module connects to an end of the modular combined socket.

11. A modular combined socket comprising:

a circuit module having at least four conductive paths connected to each other;

at least two socket modules;

a connection module having a connection module interface and a socket interface that include a power interface and a line module interface with at least four conductive paths connected to each other, and the connection module;

a socket interface connected to the connection module interface of the line module through the line module interface; and wherein the socket module includes a power output socket and a line interface connected to each other, such that different socket modules can be connected to different conductive paths of said socket interface through respective line interfaces.

12. The modular combined socket according to claim 11, wherein the socket module is square.

13. The modular combined socket according to claim 11, wherein each socket module includes two power output sockets arranged on a pair of opposite surfaces of the socket module.

14. The modular combined socket according to claim 12, wherein two connection module interfaces are respectively arranged at both ends of the line module and the socket interface.

15. The modular combined socket according to claim 14, wherein the two socket interfaces are arranged on the same plane of the circuit module and are arranged in parallel and respectively connected to the two socket interfaces through the line interface.

16. The modular combined socket according to claim 11, wherein the connection module interface includes a first connection module interface and a second connection module interface.

17. The modular combined socket according to claim 11, wherein the circuit module comprises a circuit housing and at least four mutually insulated circuits arranged in the circuit housing where the respective sockets at both ends of the module form the connection module interface.

18. The modular combined socket according to claim 11, further comprising an intermediate joint module, where two ends of the intermediate joint module are provided with interconnecting intermediate interfaces suitable for connecting with the connection module interface.

19. The modular combined socket according to claim 11, where the socket module comprises a socket housing, a socket conductor and a socket panel.

20. The modular combined socket as in claim 11, further comprising a power supply assembly comprising a power cable, a connecting cable and at least two modular combined sockets at one end of the power cable.

* * * * *